US007908697B2

(12) United States Patent
Lavabre et al.

(10) Patent No.: US 7,908,697 B2
(45) Date of Patent: Mar. 22, 2011

(54) MOTORISED POOL-CLEANING DEVICE COMPRISING CANTILEVERED MOTOR MOVEMENT TRANSMISSION MEANS

(75) Inventors: Vincent Lavabre, Toulouse (FR); Maxime Puech, Dremil Lafage (FR)

(73) Assignee: PMPS Technologies, Quint-Fonsegrives (FR)

( * ) Notice: Subject to any disclaimer, the term of this patent is extended or adjusted under 35 U.S.C. 154(b) by 1082 days.

(21) Appl. No.: 11/579,685

(22) PCT Filed: May 10, 2005

(86) PCT No.: PCT/FR2005/001157

§ 371 (c)(1), (2), (4) Date: Nov. 6, 2006

(87) PCT Pub. No.: WO2005/116371

PCT Pub. Date: Dec. 8, 2005

(65) Prior Publication Data

US 2008/0250580 A1 Oct. 16, 2008

(30) Foreign Application Priority Data

May 12, 2004 (FR) ..... 04 05105

(51) Int. Cl.
*E04H 4/16* (2006.01)

(52) U.S. Cl. ..... 15/1.7; 15/300.1; 15/387; 15/404

(58) Field of Classification Search ..... 15/1.7, 15/387, 404, 400, 398, 402, 397, 300.1
See application file for complete search history.

(56) References Cited

U.S. PATENT DOCUMENTS 6,886,205 B1 * 5/2005 Pichon ..... 15/1.7

FOREIGN PATENT DOCUMENTS

WO WO 02/50388 6/2002

* cited by examiner

*Primary Examiner* — Shay L Karls
(74) *Attorney, Agent, or Firm* — Young & Thompson

(57) ABSTRACT

A motorised pool-cleaning device (1) includes: a suction element (30); a rotary element (4) for moving the device, which define first (2) and second (3) bearing axles; a support (18) consisting of (i) a first central part (24) and (ii) first (25) and second (26) side covers which are connected to either side of the first central part, such as to form the chassis of the motorised device, and which support the rotary movement element (4); and a drive element (16, 17) for rotating the rotary movement element (4), which are disposed on the first and second side covers in a cantilevered manner.

20 Claims, 8 Drawing Sheets

MOTORISED POOL-CLEANING DEVICE COMPRISING CANTILEVERED MOTOR MOVEMENT TRANSMISSION MEANS

The present invention relates to a motorised pool-cleaning apparatus comprising suction means and rotary means for displacing the apparatus, which rotary means define first and second bearing axles.

BACKGROUND OF THE INVENTION

Prior art teaches of such motorised pool-cleaning robots, intended to clean the immersed surfaces of a pool or the like, and the water of said pool, by moving and rubbing on the surfaces, and by sucking the water of the pool into a suction pump, placed in the robot, and expelling it outwardly therefrom. These robots comprise motorised brush rollers which are intended to permit the displacement of the robot on the surfaces to be cleaned, by adherence and/or sliding induced by the weight of the robot on the horizontal surfaces, aided by low pressure caused by the suction of the water, more especially for the vertical surfaces, and generally by a floating handle, intended substantially to permit the adherence of the robot on the vertical portions.

Such robots possess a structure which is little suited to maintenance, the means for transmitting the drive movement to the rotating means for displacing the apparatus being difficult to access, necessitating for this reason a considerable period of time for a maintenance operation, operations which have to be considered as relatively frequent for apparatuses of this type, which function in an immersed medium and are intended to ensure a function of cleaning the immersed surfaces of swimming pools and the water which they contain. Generally, a maintenance operation on the transmission of such robots, for example to replace worn-out parts, requires a dismantling of one or more fixed lateral repair plates, often forming part of the rigidity of the assembly.

SUMMARY OF THE INVENTION

The present invention permits these disadvantages to be overcome and other advantages to be proposed. More precisely, it consists of a motorised pool-cleaning apparatus comprising:

- suction means,
- rotary means for displacing said apparatus and defining first and second bearing axles,
- characterised in that it comprises:
- a support including:
  - a first central portion,
  - a first and a second lateral casing, associated with said first central portion on both sides of said central portion so as to form a chassis of said motorised apparatus, and carrying said rotary means for displacing the apparatus, and
- rotational entrainment means for said rotary displacement means, disposed in an overhanging manner on said first and second lateral casings.

The proposed structure, with an overhanging transmission for the drive movement to the rotary means for displacing the apparatus placed on the lateral casings, permits rapid and direct access to these members without having to dismantle the central compartment of the apparatus, for example by separating these members from the central portion of the chassis. Moreover, one characteristic of the overhang is that it permits the elimination of the fixed lateral repair plates of the ends of the axles of the rotational entrainment means of the rotary displacement means, such as mentioned above and such as they appear on robots of prior art, these fixed lateral repair plates having the disadvantage of multiplying the risks of harming the coating of the pool in which the robot is used.

According to an advantageous feature, said rotary displacement means are placed in an overhanging manner on said first and second lateral casings, on the side of these casings which is turned towards said first central portion.

The overhanging placement of the rotary displacement means, on the two lateral casings, combined with the overhanging transmission on the lateral casings, permits an apparatus to be provided which includes two displacement groups, comprising the transmission and displacement rollers or the like, connected to the two lateral casings respectively, which are capable of being connected independently of one another on the central portion of the apparatus, or more precisely on the central portion of the support which forms the chassis, a maintenance operation on one of the displacement groups not requiring the central portion of the apparatus to be opened.

According to an advantageous feature, the apparatus according to the invention additionally comprises:

- first and second lateral caterpillar means on said support on both sides of said support,
- first and second entrainment means for said first and second caterpillar means respectively, associated with one at least of said first or second bearing axles, and connected to said support by means of a connection with a degree of rotational freedom,
- said first and second entrainment means for said first and second caterpillar means being respectively placed in an overhanging manner on said first and second lateral casings, on the side of these casings opposite to the side which is turned towards the first central portion.

The caterpillar means permit the apparatus according to the invention to cross obstacles which cannot be crossed with the single rotating rollers, for example steps. The overhanging mounting of the rotary displacement means and of the entrainment means for the caterpillars permits easy access by an operator to these members, which are all advantageously visible without any dismantling. The caterpillar means and their entrainment means, connected to the lateral casings, permit, as explained previously, an apparatus structure to be proposed which has two lateral displacement groups, which are connected in an independent manner to the central portion of the chassis of the apparatus.

According to an advantageous feature, said first and second entrainment means of said first and second caterpillar means respectively include four driving wheels, connected in groups of two by means of a first and a second transmission belt, and aligned in the same plane.

According to an advantageous feature, two of said four driving wheels of said first or second entrainment means of said first or second caterpillar means are aligned with said rotary means for displacing the apparatus and integral with said rotary means respectively.

According to an advantageous feature, the two other wheels of said four driving wheels, which are not aligned with said rotary means for displacing the apparatus, are connected in an overhanging manner on said first or second lateral casing through the intermediary of two transmission wheels respectively, placed in an overhanging manner on the side of the first or second lateral casing which is turned towards the first central portion of the support.

According to an advantageous feature, said rotary means for displacing the apparatus and defining one at least of said first and second bearing axles include a first and a second rotating roller, the respective axes of rotation of which are aligned on said one at least of said first and second bearing axles, and in that said first and second rotating rollers are connected by a connection of the freewheel type.

The freewheel connection between two aligned rollers of one bearing axle permits the two rotating rollers to be entrained simultaneously in a given direction of rotation which corresponds to the forward movement of the apparatus, which can be called a pool robot when its functioning is automated, by only motorising one of the rollers. In the reverse direction of rotation of the reduction motor, only the motorised roller is entrained in reverse rotation, corresponding to the rearward movement of the robot, the other roller no longer being entrained because of the freewheel. Thus, it is possible to make the robot turn by simply reversing the direction of rotation of a reduction motor, the robot then turning substantially about the non-entrained roller and being connected to the entrained roller by the freewheel connection. Thus, the apparatus according to the invention advances in a straight line in the direction of entrainment of the freewheel, and turns on itself when the direction of rotation of the reduction motor is reversed. Appropriate alternative cycles of moving backward and moving forward may thus permit the apparatus to sweep all of the immersed surfaces of a pool by friction. The freewheel permits the apparatus to function by means of a single motor, and allows internal space to be freed or the internal members to be arranged differently, for better distribution of the masses and better dimensions, more especially a reduction in the height of the apparatus.

According to an advantageous feature, the apparatus according to the invention comprises:

a single reduction motor secured on said first central portion of said support, said central portion having a U shape, and first means for rotationally entraining one of said first or second rotating rollers by said single reduction motor.

The use of a single motor or reduction motor additionally permits a centrifuge suction pump to be housed in the apparatus, for example, more efficient but more bulky than pumps with traditional vanes, while keeping reduced exterior dimensions.

According to an advantageous feature, said single reduction motor is in contact with said two transmission wheels.

This feature translates the kinematic connection of the drive transmission between the central portion of the chassis carrying the drive axle of the reduction motor, and a lateral casing carrying a displacement group.

According to an advantageous feature, said rotary means for displacing said apparatus and defining the other of said first and second bearing axles include a third and a fourth rotating roller, the respective axes of rotation of which are aligned on said other of said first and second bearing axles, and in that said third and fourth rotating rollers are connected by a connection of the freewheel type.

Thus, two bearing axles, motorised in an identical manner with a freewheel, permit the drive of the apparatus according to the invention to be improved, while benefiting from the functioning principle described above with one motorised bearing axle. The apparatus according to the invention, provided with four brush rollers, advances in a straight line in the direction of entrainment of the freewheels, and turns on itself when the direction of rotation of the reduction motor is reversed.

According to an advantageous feature, the apparatus according to the invention comprises in addition second means for rotationally entraining one of said third or fourth rotating rollers by said single reduction motor.

According to an advantageous feature, said connection or connections of the freewheel type comprises or comprise, respectively, a helical resilient washer and at least one lug capable of abutting against one end of said helical washer in a first direction of rotation and of sliding on said washer in the second opposite direction of rotation.

According to an advantageous feature, said suction means comprise a pump of the centrifuge type.

According to an advantageous feature, said first and second means, for rotationally entraining one of said first or second rotating rollers and one of said third or fourth rotating rollers, comprise said first and second transmission belts.

According to an advantageous feature, the apparatus according to the invention comprises two fixed gripping handles, disposed beneath an upper level which is defined by the highest surface of said apparatus.

According to an advantageous feature, said two fixed gripping handles are parallel to said first and second bearing axles and disposed above these axles.

According to an advantageous feature, the apparatus according to the invention comprises a rotating electric connector for a connection to an electric supply cable, which permits said electric supply cable to be connected to said apparatus according to a connection with a degree of rotational freedom.

Other features and advantages will appear on reading the following description of one embodiment of a motorised pool-cleaning apparatus according to the invention, together with the accompanying drawings, an embodiment given by way of non-limiting illustration.

DETAILED DESCRIPTION OF THE PREFERRED EMBODIMENTS

Figure 1:
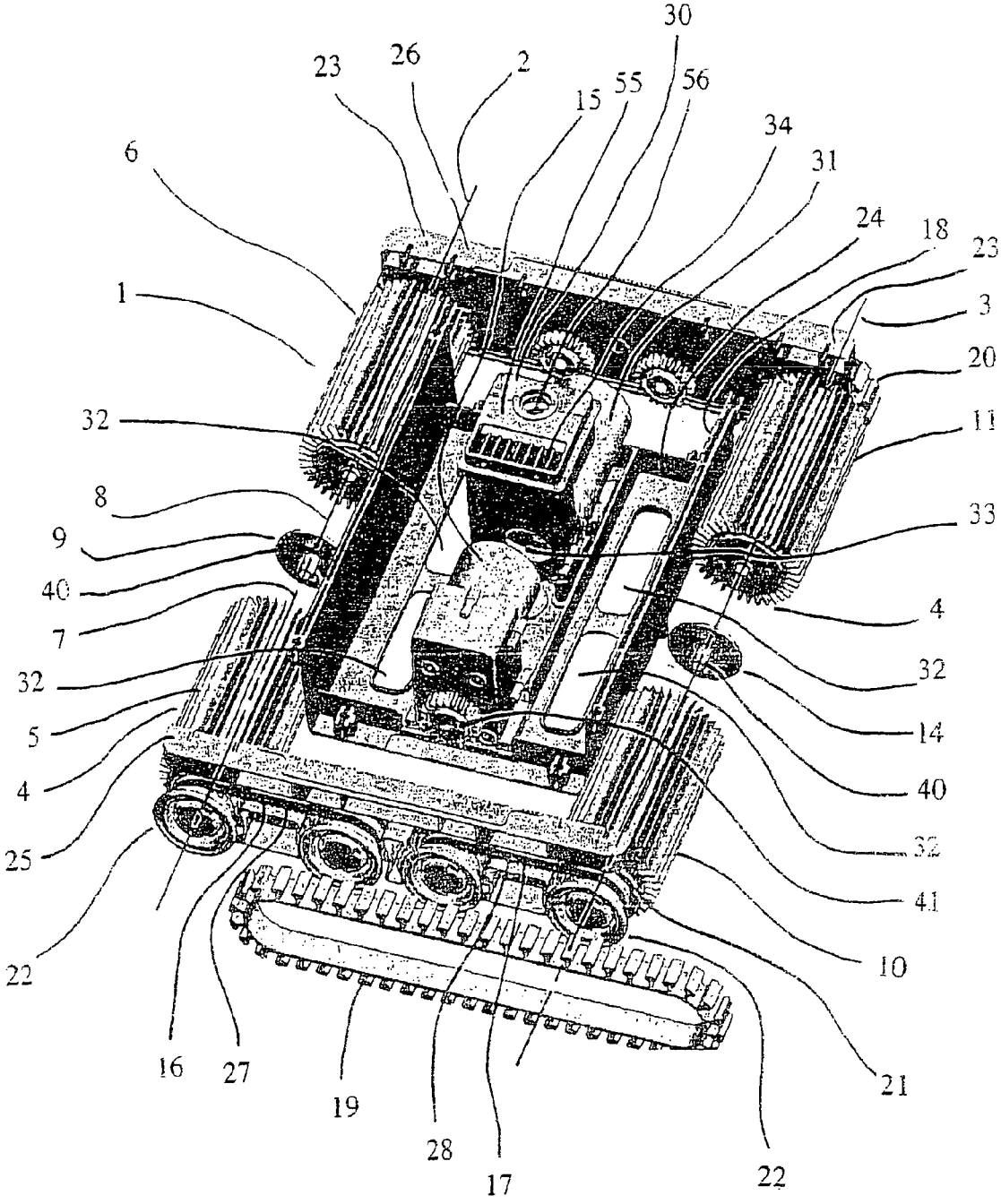
FIG. 1 is a perspective fragmentary partial plan view of one embodiment of a motorised pool-cleaning apparatus according to the invention.

The motorised pool-cleaning apparatus 1 illustrated in FIG. 1 comprises:

suction means 30, rotary means 4 for displacing the apparatus and defining the first 2 and second 3 bearing axles, comprising respectively a first 5 and a second 6 rotating roller, the respective axes of rotation 7,8 of which are aligned on the first bearing axle 2, and advantageously a third 10 and a fourth 11 rotating roller, the respective axes of rotation 12, 13 of which are aligned on the second bearing axle 3, the first 5 and second 6 rotating rollers being connected by a connection 9 of the freewheel type, and the third 10 and fourth 11 rotating rollers being connected by a connection 14 of the freewheel type, preferably a single reduction motor 15, first means 16 for rotationally entraining one of the first 5 or second 6 rotating rollers by the single reduction motor, in this case the first rotating roller 5 in the example illustrated, and second means 17 for rotationally entraining one of the third 10 or fourth 11 rotating rollers by the single reduction motor 15, in this case the third rotating roller 10 in the example illustrated in FIG. 1, advantageously a support 18 on which is secured the single reduction motor 15, first 19 and second 20 lateral caterpillar means on the support 18 on both sides of said support, first 22 and second 23 means for entraining the first 19 and second 20 caterpillar means associated with the first 2 and second 3 bearing axles respectively, the first 22 and second 23 entrainment means being connected to the support 18 by means of a connection with a degree of rotational freedom.

Figure 4:
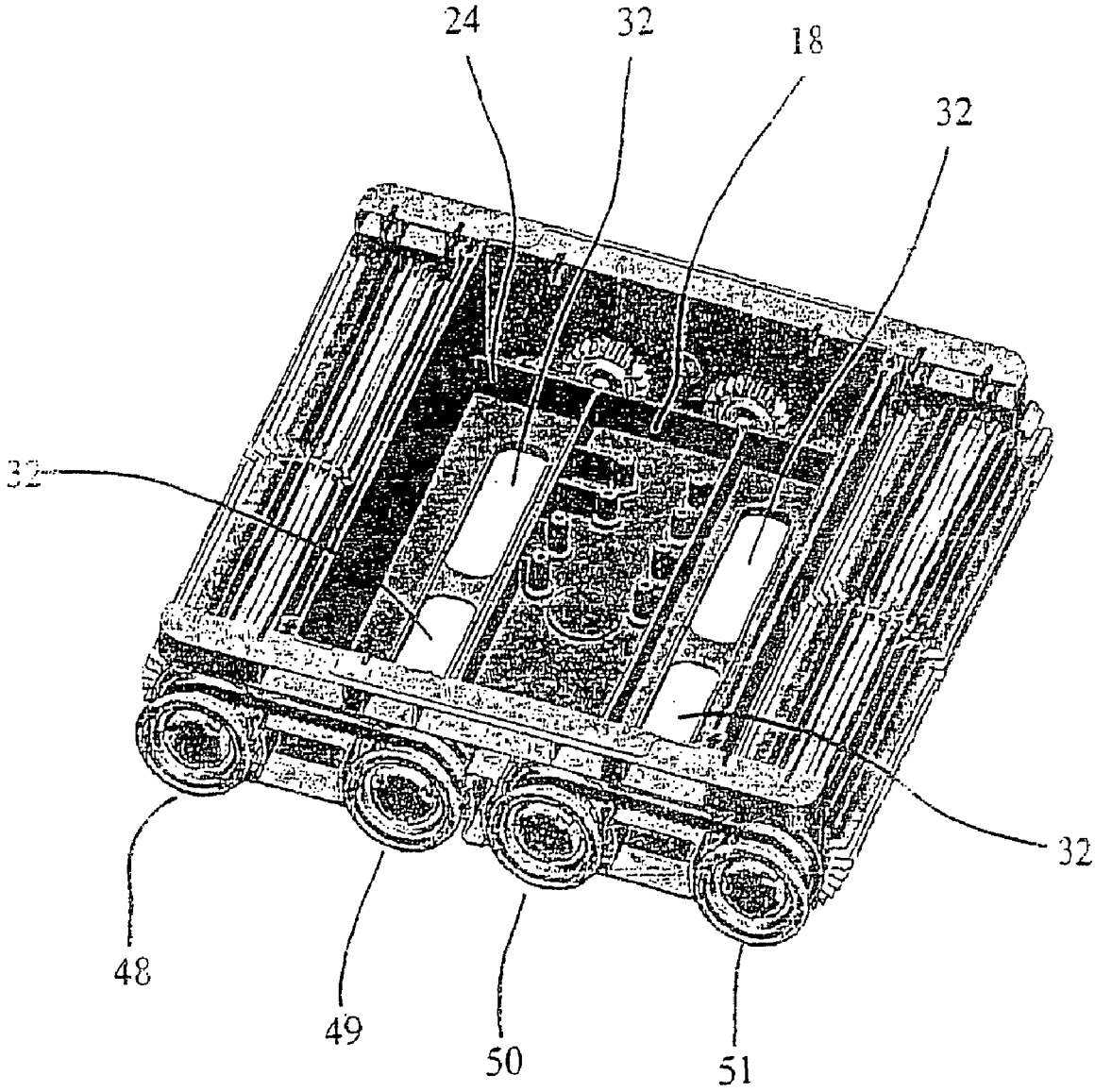
FIG. 4 is a perspective plan view of the example in FIG. 1, partially assembled.
Figure 7:
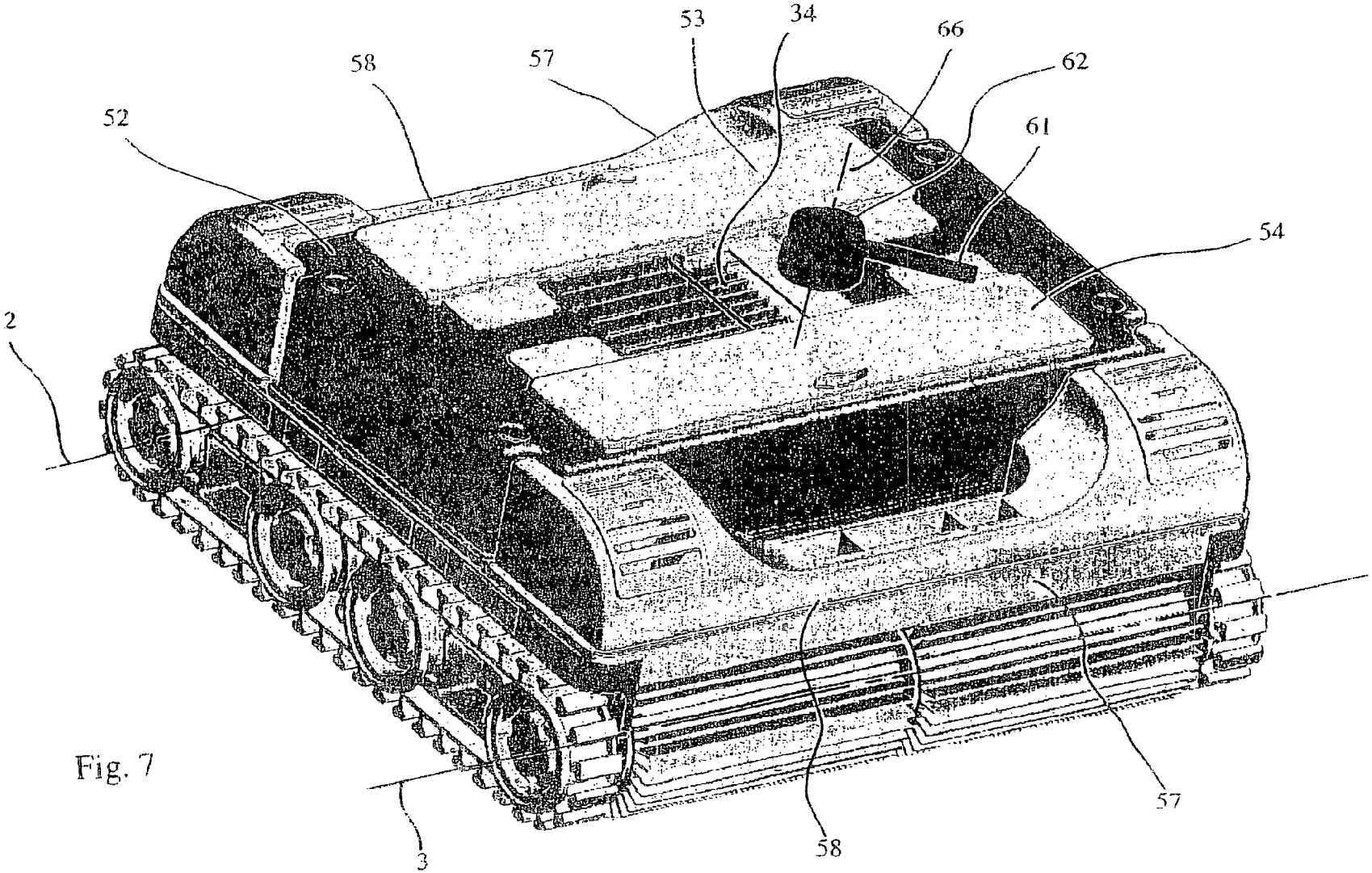
FIG. 7 is a perspective plan view of the complete embodiment in FIG. 1.

The suction means 30 advantageously comprise a pump of the centrifuge type 31, more efficient than a vane pump and also more bulky, but housable in the support 18, which is advantageously in the form of a U as illustrated in FIG. 1, thanks to the use of a single reduction motor. The reduction motor 15 and the centrifuge pump 31 are positioned centrally in the axis of the U, and preferably aligned along the longitudinal axis of the U, in order to free a space for the filters (not illustrated for reasons of clarity in the Figure) on both sides of the reduction motor 15 and pump 31 assembly, in front of and behind these members. The water is sucked into the apparatus 1 through orifices 32 provided in the lower portion of the U which forms the support 18, as illustrated in FIG. 1 or 4, then passes through the filters placed above, then enters the inlet opening 33 of the centrifuge suction pump 31, in order to be forced-back through the outlet opening 34 of this pump, which outlet terminates on the upper surface of the apparatus, as illustrated in FIG. 7.

Figure 5:
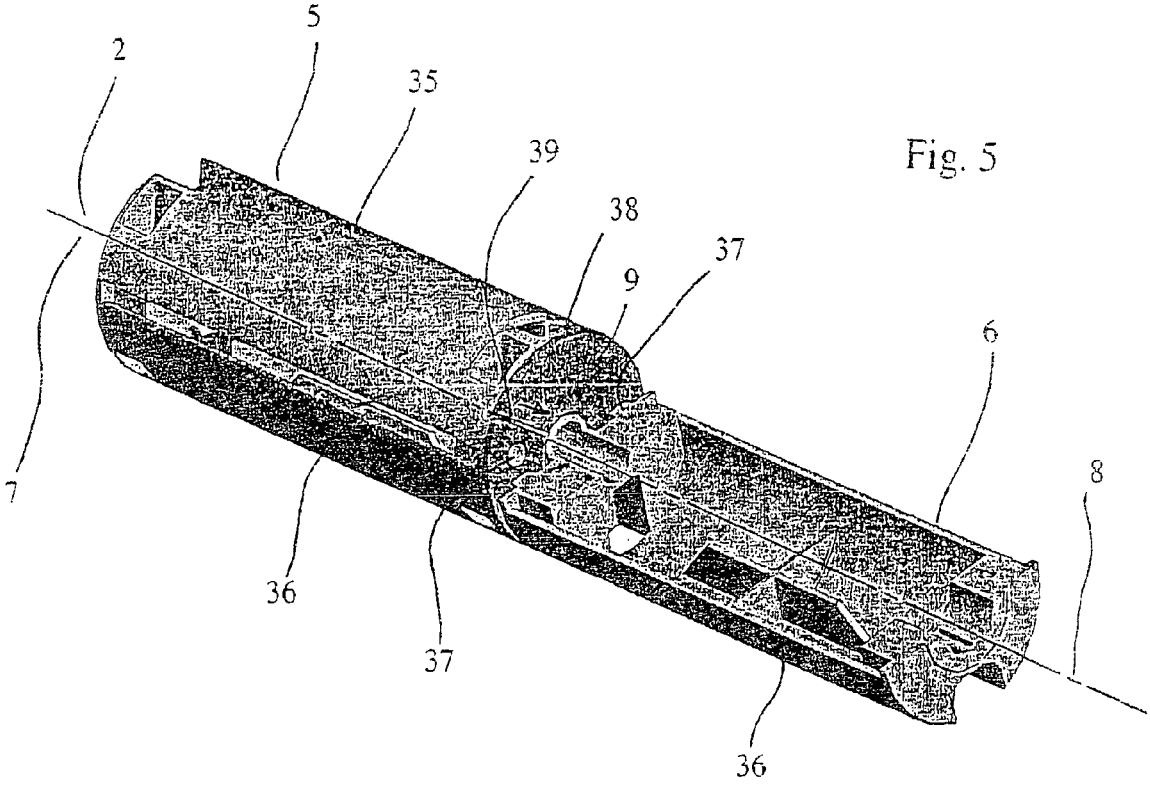
FIG. 5 shows an enlarged assembly detail of the apparatus in FIG. 1.

The rotating rollers 5, 6, 10 and 11 are advantageously identical and each formed by two half-shells 35 and 36, screwed one onto the other in order to form a cylinder of circular cross-section as illustrated in FIG. 5, which shows, in a fragmentary view, two rotating rollers forming one of the two bearing axles 2, 3. One end of the half-shells includes at least one lug, which has the function of entraining the freewheel 9 placed between two rollers and connecting these rollers by a connection which rotates in only one direction. In addition, said end of the half-shells includes a supplementary lug 37 for the rotational immobilisation of the freewheel on one of the two aligned rollers, so that the driven roller entrains the other aligned roller in one direction of rotation and no longer entrains it in the opposite direction of rotation. It is to be noted that, in FIG. 5, one half-shell of a roller has not been illustrated, in order to permit the freewheel to be seen. Each-half shell advantageously includes, at each end, a half-bore, the appropriate shape of which permits a connection of the rollers to the apparatus, more particularly to the support, according to a connection with a degree of rotational freedom. The cylindrical surface of each rotating roller is covered with a flexible brush of any known kind, for example formed from elastomer, secured on the roller, capable of transmitting the drive couple and of ensuring the adherence of the apparatus on the walls of a pool.

Figure 8:
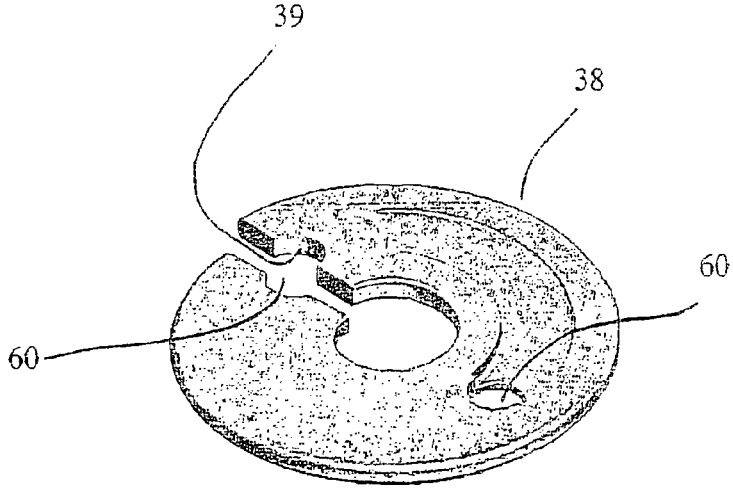
FIG. 8 shows an enlarged assembly detail of the apparatus in FIG. 5.

The connections 9, 14 of the freewheel type include a helical resilient washer 38, rotationally connected to one of the rollers of the bearing axle 2, 3 respectively, and at least one lug 37, which is integral with the other roller of the bearing axle in question, capable of abutting against the washer 38 in a first direction of rotation, more particularly of abutting against the radial portion 39 projecting axially from the helical washer, as illustrated in FIG. 8, and of sliding on said portion in the second opposite direction of rotation, as a result of its elasticity. The resilient washer 38 is rotationally connected to one of the rollers of the bearing axle, for example by means of a lug 37 which penetrates into a housing 60 of the helical washer 38. In a preferential manner, each rotating roller 5, 6, 10 and 11 includes two diametrically opposed lugs, and each washer includes two corresponding, diametrically opposed housings 60, in which are respectively accommodated the two lugs 37 of a roller. One of the housings 60, provided on the resilient washer 38, preferably intercepts the radial stop member 39, as illustrated in FIG. 8, so that the lug 37 of the roller which is not rotationally connected to the washer 38 can press against a stop member 39, profiled in a cylindrical form complementary to that of the lug in order to ensure a better distribution of the forces. It is to be noted that FIG. 5 illustrates, differently from FIG. 8, another embodiment of the resilient washer 38, in which the housing 60 provided on this washer does not intercept the radial stop member 39. As illustrated in FIG. 1, the helical resilient washer 38 may include an axle 40, which projects axially on both sides of the washer and permits rotational guidance in the ends of the aligned rollers between which it is disposed.

The support 18 advantageously comprises a first portion 24 in the shape of a U, on which is secured the single reduction motor 15, a first 25 and a second 26 lateral casing which close the open lateral ends of the U, secured respectively in a releasable manner, for example by a screw, on the first portion 24 of the support 18, and carrying respectively the rotating rollers 5, 6 and 10, 11.

Figure 2:
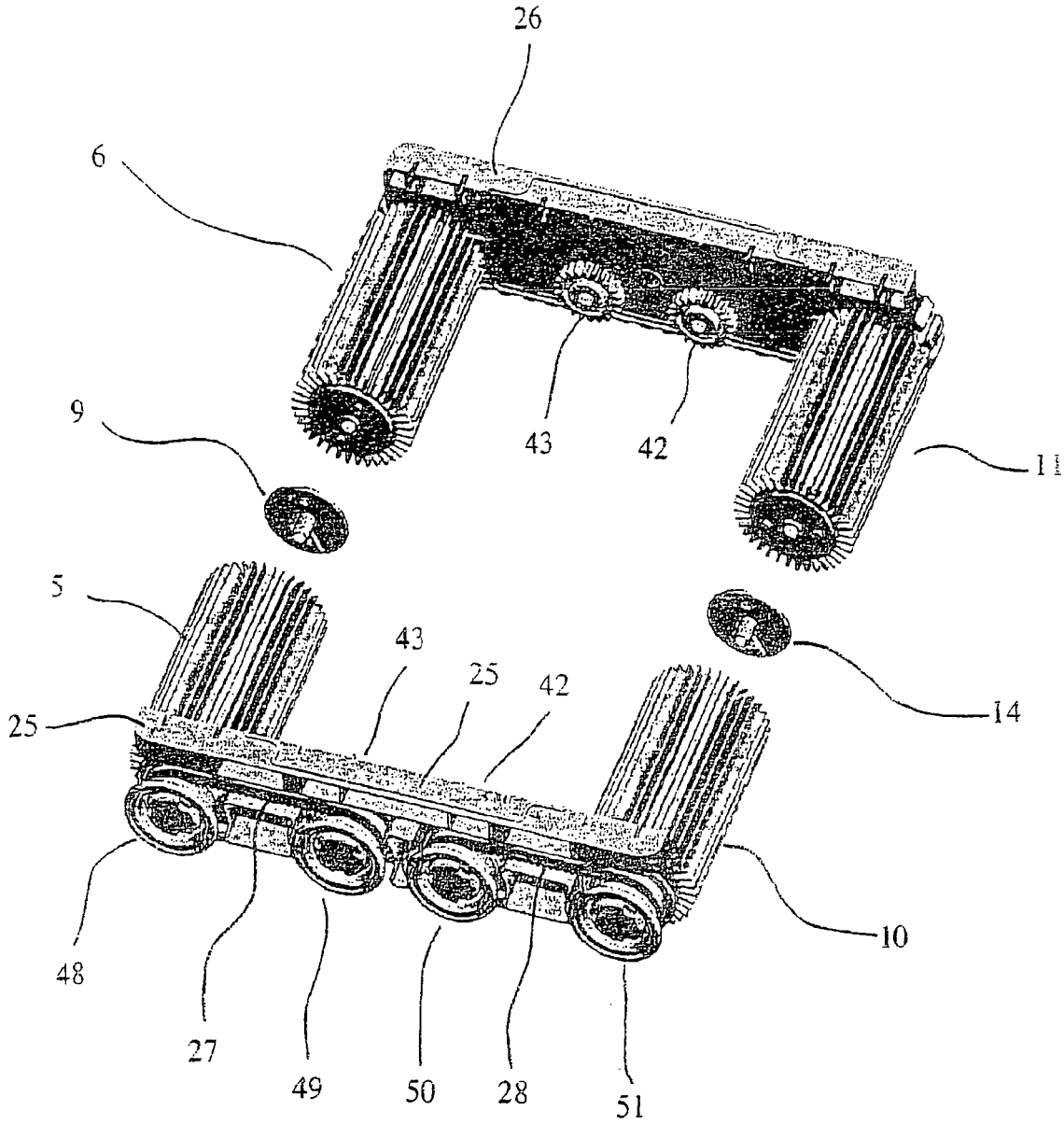
FIG. 2 is a perspective fragmentary plan view of one detail in FIG. 1.
Figure 3:
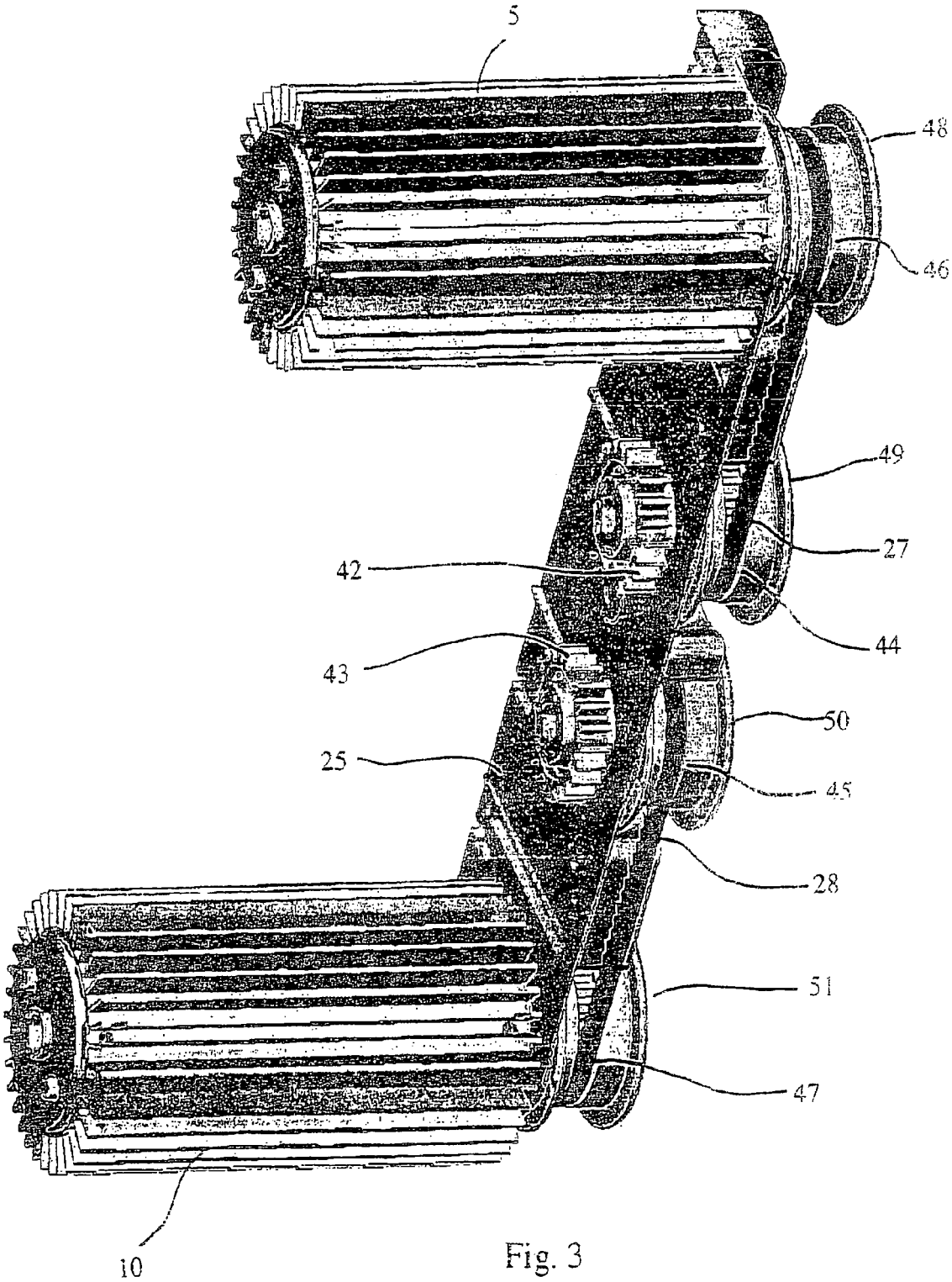
FIG. 3 is a perspective underneath view of an enlarged detail of FIG. 1.

The transmission of the driving movement of the reduction motor 15 to the rotating rollers 5 and 10, which are integral with the first lateral casing 25, is advantageously effected in the following manner via the first 16 and second 17 rotational entrainment means: the driving spindle of the reduction motor is provided with an entrainment pinion 41, in engagement with two transmission pinions 42, 43, which are integral with the lateral casing 25 by a connection with a degree of rotational freedom. The rotational movement of the transmission pinions is then transmitted to the rollers 5 and 10 via a first 27 and a second 28 synchronous transmission belt, respectively, in contact with two pulleys 44, 45 which are rigidly connected to the two transmission pinions 42, 43, and with two pulleys 46, 47 which are rigidly connected to the two rotating rollers 5, 10 respectively, as illustrated in FIG. 2 or 3. The bearing axles 2 and 3, the rotational axes of the transmission pinions 42, 43 and of the driving pinion 41, as well as the axes of rotation of the pulleys 44, 45, 46, 47 are advantageously horizontal and parallel.

As illustrated in FIG. 1, 2 or 3, the first 25 and second 26 lateral casings respectively carry, in addition, the first 22 and second 23 entrainment means of the first 19 and second 20 caterpillar means, and the first 5, second 6, third 10 and fourth 11 rotating rollers are placed in an overhanging manner on the side of the first 25 and second 26 lateral casings respectively turned towards the first U-shaped portion 24 of the support 18, the first 22 and second 23 entrainment means of the first 19 and second 20 caterpillar means being respectively placed in an overhanging manner on the opposite side of the lateral casings 25, 26.

The first 22 and second 23 entrainment means of the first 19 and second 20 caterpillar means comprise respectively four driving wheels 48, 49, 50, 51, connected in groups of two advantageously by means of the first 27 and second 28 transmission belts.

The four driving wheels 48, 49, 50, 51 each advantageously assume the form of a rim with lateral edges, as shown in FIG. 1, 2 or 3, on which rim the caterpillar means is placed and adheres by friction. These rims 48, 49, 50, 51 each include a central groove capable of housing the corresponding belt 27, 28, so that the exterior diameter of the belt is less than the diameter of the rim on which the caterpillar rests. The caterpillars can extend beyond the edge of the wheels, for example with caterpillar clamps covering the edge of the wheels, and thereby prevent a hard portion of the apparatus being able to come into contact with the coating of the pool, in this case the edge of the wheels, the caterpillars advantageously being made from flexible material of the elastomeric type or similar, while the wheels will preferably be made from a hard material of the rigid plastics material type.

FIG. 3 shows a lateral transmission assembly or displacement group made up of two rotating wheels 5 and 10, the four driving wheels 48, 49, 50 and 51 for entraining the caterpillar, connected two by two by a belt 27, 28, and the lateral casing 25 connecting these members, and FIG. 2 shows the two lateral transmission assemblies, which are advantageously identical, the rotating wheels 5, 6 and 10, 11 of which are respectively connected by the freewheel connections 9 and 14. It is evident that, for reasons of simplifying the production of the apparatus described, the two lateral transmission assemblies include transmission pinions 42 and 43, making these assemblies perfectly identical, while only one of these assemblies would necessitate the presence of such pinions, namely the assembly of which the transmission pinions are in contact with the pinion of the reduction motor 15. The purpose of having two identical transmission assemblies is of course obvious, from the point of view of reducing the manufacturing costs.

The end wheels 48, 51 of the caterpillars 19, 20 are advantageously aligned on the bearing axles 2 and 3 defined respectively by the axes of rotation of the rotating rollers 5, 6, 10 and 11, more especially in order to improve the guidance of the caterpillars. The end wheels 48 and 51 are associated, in a rigid and dismantlable manner, with the corresponding rotating roller through the intermediary of a spindle traversing the lateral casing in a bearing provided for this purpose, and penetrating into an appropriate bore of the roller. In addition, the four driving wheels 48, 49, 50 and 51 for entraining the caterpillar are situated in the same plane and possess axes of rotation situated in the same horizontal plane, and this permits a very flat apparatus to be proposed.

It is to be noted that a caterpillar has not been illustrated in FIGS. 2, 3 and 4 in order to show the driving wheels for entraining said caterpillar, as well as the transmission belts. The exterior diameter of the driving wheels 48, 49, 50, 51 is designed so that the caterpillar does not hinder the motorisation of the apparatus by the rotating wheels 5, 6, 10 and 11, which must have, with their brush, a diameter greater than that of the caterpillars. In fact, it needs to be remembered that the caterpillars are only used when an obstacle is present during the displacement of the apparatus, so that the drive of the bearing axles 2 or 3 is insufficient to ensure its movement.

Figure 6:
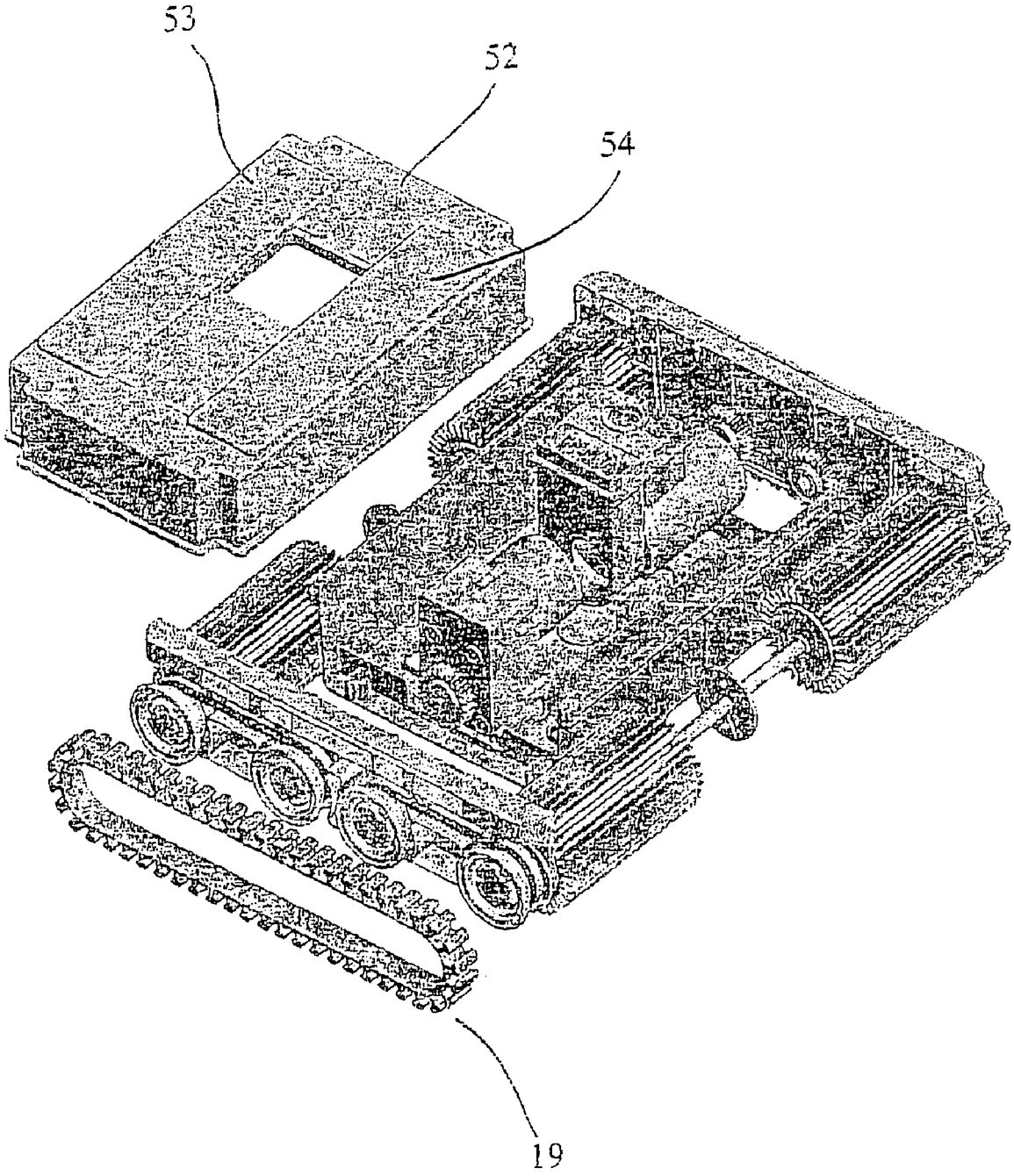
FIG. 6 is a perspective plan view of the embodiment in FIG. 1, with a supplementary member in partially fragmentary view.

FIG. 6 repeats the illustration of FIG. 1 while adding an upper hood 52, which closes the upper portion of the apparatus and, more particularly, the motor compartment comprising the reduction motor, the centrifuge pump and the filters (not illustrated). The hood, advantageously screwed onto the support 18, includes an opening intended to permit the water to be forced-back by the pump, and also advantageously includes access flaps 53 and 54 to these filters for their maintenance. The access flaps 53 and 54 are advantageously deprived of locking, in order to simplify manipulation, and make access to the filters very easy. During the functioning of the apparatus, the access flaps are kept flattened by the suction low pressure. When the pump is stopped, the access flaps, which are advantageously hinged on one of their sides and on the upper hood, serve as emptying valves by opening freely during the removal of the robot from the pool. This configuration offers an advantageous through cross-section for the water, and limits the number of discharge orifices in the robot. The filters will preferably be formed by a rigid cassette which contains the filtration material.

The extreme simplicity of the structure of the apparatus according to the invention will be noted, said structure being reduced to:

- a U-shaped support on which are secured the reduction motor and pump members,
- two lateral casings secured to the U-shaped support, which can be rapidly dismantled and include all of the transmission and the members connected with the drive of the apparatus,
- freewheels inserted between the two lateral groups, and
- an upper hood for closing the motor compartment.

The caterpillars with their driving wheels are advantageously placed in an overhanging manner on the lateral casings, so that they are entirely visible and access for maintenance is achieved without having to dismantle any structural member.

Two fixed handles 57 will advantageously be added to permit the apparatus to be gripped by the user in order to transport it to the place of use. Such fixed handles 57 may, for example, assume the form of two bars 58, advantageously parallel respectively to the bearing axles 2 and 3 and placed substantially above these bearing axles, as illustrated in FIG. 7. These handles 57 may be made integral with the upper hood 52 or with any other structural member of the apparatus, and participate in the resistant structure thereof, but should preferably not extend above the highest upper surface of the apparatus, namely, in the example illustrated, not extend above the upper hood 52, in order not to increase the height of the apparatus and not to hinder the displacement of the electric cable 61, as will be explained in more detail below.

The centrifuge pump is advantageously made up of two distinct parts, the motor with its turbine on the one hand and the guide 55 for the fluid flow on the other hand, individually screwed to the base of the support 18, the flow guide having its outlet in the upper portion of the apparatus at the opening 34 illustrated in FIG. 1. The flow guide advantageously serves as an attachment, for example at a point 56 in the vicinity of the outlet 34, for an electric connector 62, preferably rotary, of the electric supply cable 61 of the reduction motor 15 and of the suction pump 31. In the event of abnormal tension on the electric cable, the flow guide is capable of resisting this force without transmitting it either to the sealing casing of the pump motor or to the upper hood 52 of the apparatus.

It is to be noted that fluid penetrates into the apparatus, with the exception of the electric motors which must be placed in sealed protective casings according to any known method, the electric connector 62 which must be sealed as explained hereinafter by means of FIGS. 9 and 10, and more generally with the exception of all of the electric members.

The electric supply cable 61 of the apparatus is fitted, at one end, with the preferably rotary electric connector 62 and, at the other end, with a standard connector (not illustrated) for an electric connection to an electric supply box. The electric cable 61 is made up, for example, of a sheath 63 formed from flexible PVC, normally fitted with five electric wires 64 in the interior thereof, the immersed end 65 of the cable preferably being sealed to ensure a presence of air in the interior of the sheath 63, so necessary for the flotation of the cable. The rotary connector 62 advantageously serves as an attachment strap for the cable, directly or indirectly, and prevents it from kinking.

Figure 9:
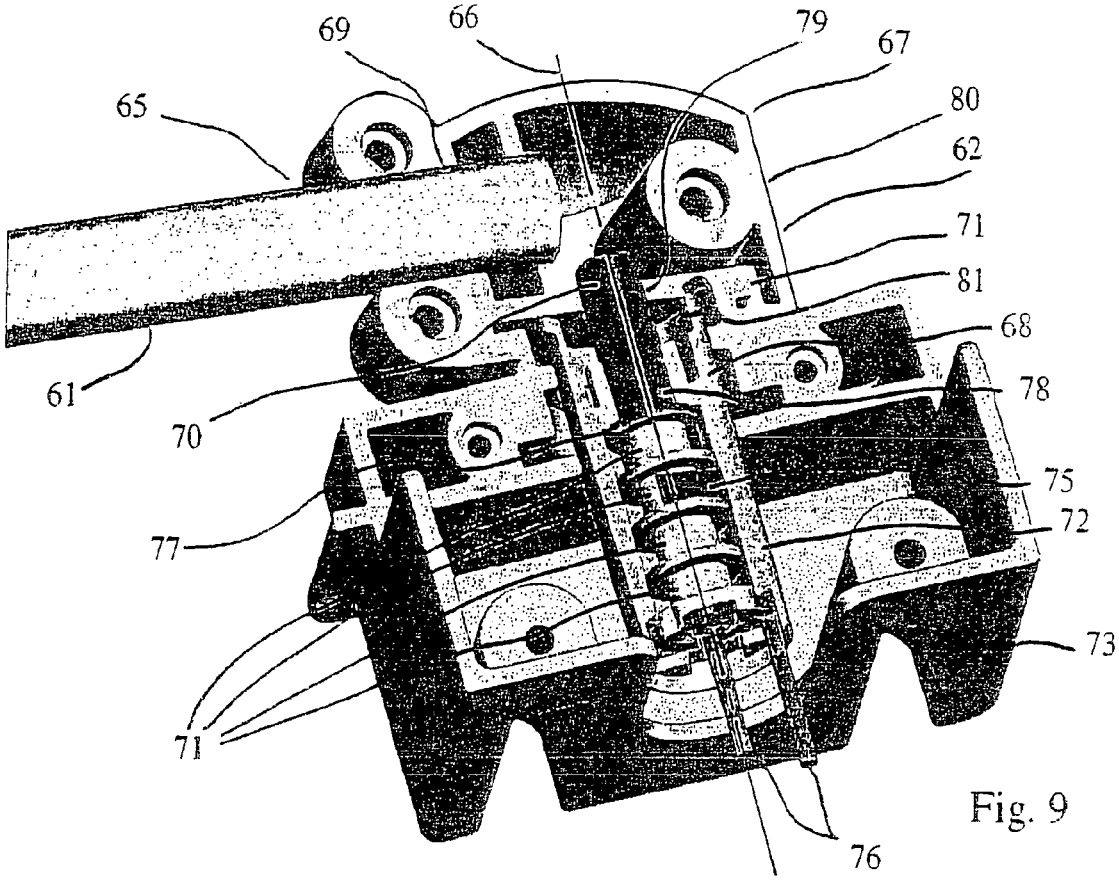
FIGS. 9 and 10 are perspective and cross-sectional (FIG. 9) views of an enlarged detail of FIG. 7.
Figure 10:
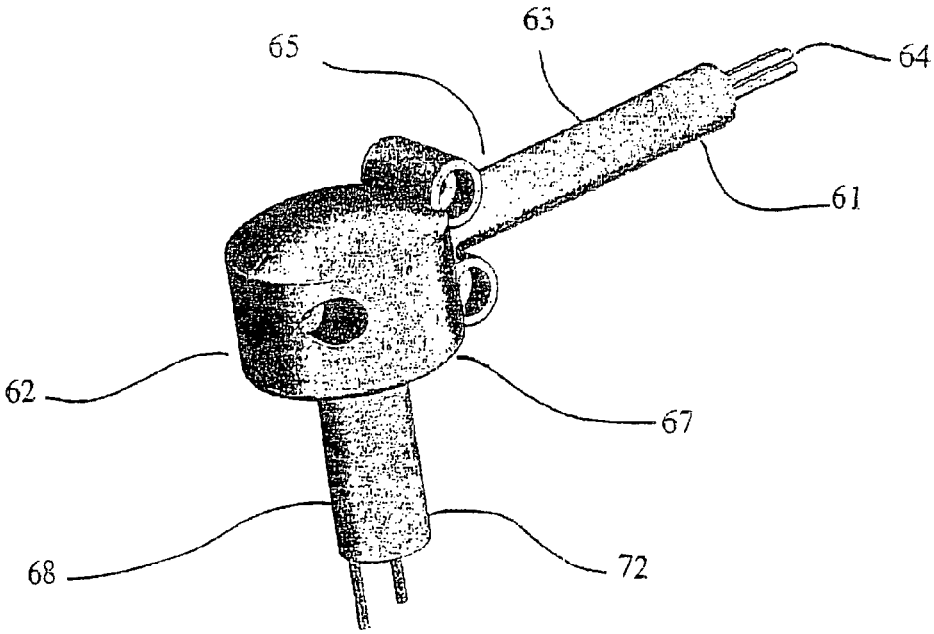

As illustrated in FIGS. 7, 9 and 10, the electric connector 62 is preferably rotational along a vertical axis 66, with a radial horizontal inlet for the supply cable 61 on a turning portion 67 of the connector 62. Thus, the rotation of the turning portion 67 of the connector 62 is induced by the displacement inertia of the cable 61 and not by its torsional resistance, and this prevents the electric cable from being subjected to excessive fatigue forces, extending its service life and facilitating its manipulation. Thus, the supply cable 61 does not require any specific torsional performance in order to make the turning portion 67 of the connector 62 turn.

The electric connector 62 is now going to be described in more detail with one embodiment according to FIGS. 9 and 10.

The turning portion 67 of the connector comprises a turret 80, which advantageously assumes a substantially cylindrical general shape, with a circular cross-section, the axis of symmetry of which is intended to be vertical, and includes a sealed radial inlet 69 for the electric cable 61. In the axis of the turret 80 is disposed a connection tube 70, which is secured to said turret by means of one rotating connection 79 at least and in the interior of which connection tube are disposed the electric wires 64 of said electric cable 61, respectively connected to conductor paths 71, arranged vertically and respectively forming cylindrical conductor rings with a circular cross-section on the exterior surface of the connection tube, in order that each electrical wire is capable of ensuring an electric connection via its circular path.

The fixed portion 68 of the connector 62 includes a guide tube 72 with a circular cross-section, enclosing the connection tube 70 and connected to the turning portion 67 by a connection with a degree of rotational freedom. The tube 72 is preferably intended to be secured in a connector strap 73, as shown in FIG. 9, which strap is itself secured to the apparatus via the guide 55 for the flow, for example. The turning portion 67 of the connector 62 is advantageously connected to the connector strap 73 through the intermediary of the turret 80 by a connection 74, which has a degree of rotational freedom and is intended to transmit the mechanical forces between the electric cable 61 and the apparatus in order to avoid pulling on the electric connection. As shown in FIG. 9, the guide tube 72 includes an interior surface provided with a number of transverse conductor strips 75, arranged to correspond with the number of circular paths 71 of the connection tube 70, each strip 75 being capable of coming into contact by friction with the corresponding conductor path 71, so as to ensure an electric connection over 360° when the electric cable 61 effects a complete revolution, that is to say when the turning portion 67, and more specifically the connection tube 70, effects a complete rotation in the guide tube 72. The electric wires 76, which are intended to supply the appropriate electric members in the apparatus and are respectively connected to the strips 75, emerge from the guide tube 72 through the lower portion thereof.

FIG. 10 illustrates the turning portion 67, which is provided with the guide tube 72 and with the electric cable 61, insulated from the connector strap 73.

The connection tube 70 advantageously includes insulating collars 77, each assuming a circular washer shape, separating the circular conductor paths 71 from one another, and the exterior cylindrical surface of which serves advantageously as a guide surface for the tube 70 in the tube 72, as illustrated in FIG. 9. The assembly of the tubes 70 and 72 may additionally include a rotating guide block 78. The connection 79 between the connection tube 70 and the turret 80 will at least be a rotating connection but, in a preferred manner, a clearance will be left between the two portions of the connection in order that the forces transmitted to the turret 80 by the electric cable 61 are not transmitted to the connection tube 70, thereby avoiding pulling on the assembly of rotating connections between the connection tube 70 and the guide tube 72.

The sealing of the electric connector 62 will advantageously be ensured on the one hand by a lip joint 81 placed between the connection tube 70 and the guide tube 72, in the upper portion of these elements at the level of the connection 74 between the turret 80 and the strap 73, and on the other hand in the base of these two tubes by a sealed resin stopper, for example blocking the base of the guide tube 72, thereby protecting all of the rotating connections between these two sealing points. The inlet of the connection tube 70 will be able to be provided with a sealed resin stopper in order to prevent liquid, which is being introduced into the turret 80, from penetrating the interior of the tube 70, where the connections of the supply wires to the circular conductor paths is effected. The turret 80, as well as the strap 73, will advantageously be provided in the form of two half shells, screwed one onto the other, thereby proposing a simple means to achieve the connection 74 with a degree of rotational freedom, and the rotating connection 79, for example of the one-piece cotter-pin, lug or grooves type, and an efficient means to achieve the sealed connection of the electric cable 61 with the turret 80 by pressure of the two half-shells on the exterior sheath 63 of the cable 61.

The apparatus according to the invention may be provided with any known means which permits its functioning to be automated, for example of the delay and reverse reduction motor drive type.

It is to be noted that the apparatus according to the invention permits the use of a conventional floating handle to be avoided, because of a low centre of gravity which permits the adherence of the robot on vertical parts to be optimised. The absence of the second reduction motor additionally permits space to be freed to position an internal float (not illustrated), which advantageously replaces the floating handle, this internal float, produced for example from polystyrene, having a more reduced volume the lighter the robot is. The internal float will preferably be housed beneath and above the reduction motor, assuming the form of a plate for example. The internal float will advantageously be able to assume any appropriate shape, molding itself into the free spaces in the interior of the U-shaped support.

The absence of a floating handle permits the upper portion of the apparatus to be freed of any displaceable member, more precisely to free the portion of the apparatus situated above the upper hood 52, and to adopt a rotary connector 62 with a radial inlet which extends, for its part, at least to the level of its radial inlet, above the highest level of the upper hood. One advantage provided by the reduced height of the apparatus according to the invention is to be able to use it on bathing areas which are not very deep.

The invention claimed is:

1. A motorized pool-cleaning apparatus (1), comprising:

suction means (30);

rotary means (4) for displacing said apparatus, said rotary means defining first (2) and second (3) bearing axles;

a support (18) including a first central portion (24), a first lateral casing (25), and a second lateral casing (26), the first and second lateral casings (25,26) respectively located on opposite first and second sides of said central portion so as to form a chassis, said chassis carrying said rotary means (4) for displacing the apparatus; and rotational entrainment means (16, 17) for said rotary displacement means (4), disposed in an overhanging manner on said first and second lateral casings.

2. The apparatus according to claim 1, wherein said rotary displacement means (4) are placed in an overhanging manner on said first and second lateral casings, on the side of these casings which is turned towards said first central portion.

3. The apparatus according to claim 2, further comprising:

first (19) and second (20) lateral caterpillar means on said support (18) on both sides of said support; and first (22) and second (23) means for entraining said first and second caterpillar means respectively, associated with one at least of said first (2) or second (3) bearing axle, and connected to said support by means of a connection with a degree of rotational freedom, said first (22) and second (23) means for entraining said first (19) and second (20) caterpillar means being respectively placed in an overhanging manner on said first (25) and second (26) lateral casings, on the side of these casings opposite to the side which is turned towards the first central portion (24).

4. The apparatus according to claim 2, wherein said rotary means, for displacing the apparatus and defining one (2) at least of said first and second bearing axles, include a first (5) and a second (6) rotating roller, the respective axes of rotation (7, 8) of which are aligned on said one (2) at least of said first and second bearing axles, and wherein said first (5) and second (6) rotating rollers are connected by a connection (9) of the freewheel type.

5. The apparatus according to claim 1, further comprising:

first (19) and second (20) lateral caterpillar means on said support (18) on both sides of said support; and first (22) and second (23) means for entraining said first and second caterpillar means respectively, associated with one at least of said first (2) or second (3) bearing axle, and connected to said support by means of a connection with a degree of rotational freedom, said first (22) and second (23) means for entraining said first (19) and second (20) caterpillar means being respectively placed in an overhanging manner on said first (25) and second (26) lateral casings, on the side of these casings opposite to the side which is turned towards the first central portion (24).

6. The apparatus according to claim 5, wherein said first (22) and second (23) means for entraining said first (19) and second (20) caterpillar means respectively include four driving wheels (48, 49, 50, 51), connected in groups of two by means of a first (27) and a second (28) transmission belt, and aligned in the same plane.

7. The apparatus according to claim 6, wherein two (48, 51) of said four driving wheels of said first (22) or second (23) means for entraining said first (19) or second (20) caterpillar means are aligned with said rotary means (4) for displacing the apparatus and integral with said rotary means respectively.

8. The apparatus according to claim 7, wherein the two other wheels (49, 50) of said four driving wheels, which are not aligned with said rotary means (4) for displacing the apparatus, are connected in an overhanging manner on said first (25) or second (26) lateral casing through the intermediary of two transmission wheels (43, 42) respectively, placed in an overhanging manner on the side of the first or second lateral casing which is turned towards the first central portion (24) of the support (18).

9. The apparatus according to claim 8, wherein said rotary means, for displacing the apparatus and defining one (2) at least of said first and second bearing axles, include a first (5) and a second (6) rotating roller, the respective axes of rotation (7, 8) of which are aligned on said one (2) at least of said first and second bearing axles, and wherein said first (5) and second (6) rotating rollers are connected by a connection (9) of the freewheel type.

10. The apparatus according to claim 9, further comprising:

a single reduction motor (15) secured on said first central portion (24) of said support (18), said central portion having a U shape; and first means (16) for rotationally entraining one of said first (5) or second (6) rotating rollers by said single reduction motor.

11. The apparatus according to claim 10, wherein said single reduction motor (15) is in contact with said two transmission wheels (43, 42).

12. The apparatus according to claim 10, wherein said rotary means (4), for displacing said apparatus and defining the other (3) of said first (2) and second (3) bearing axles, include a third (10) and a fourth (11) rotating roller, the respective axes of rotation (12, 13) of which are aligned on said other (3) of said first (2) and second (3) bearing axles, and in that said third (10) and fourth (11) rotating rollers are connected by a connection (14) of the freewheel type.

13. The apparatus according to claim 12, further comprising:

second means (17) for rotationally entraining one of said third (10) or fourth (11) rotating rollers by said single reduction motor (15).

14. The apparatus according to claim 13, wherein said first (16) and second (17) means, for rotationally entraining one of said first (5) or second (6) rotating rollers and one of said third (10) or fourth (11) rotating rollers, comprise said first (27) and second (28) transmission belts.

15. The apparatus according to claim 9, wherein said connection or connections (9, 14) of the freewheel type comprises or comprise, respectively, a helical resilient washer and at least one lug capable of abutting against one end (39) of said helical washer in a first direction of rotation and of sliding on said washer in the second opposite direction of rotation.

16. The apparatus according to claim 1, wherein said suction means (30) comprise a pump (31) of the centrifuge type.

17. The apparatus according to claim 1, further comprising:

two fixed gripping handles (57), disposed beneath an upper level which is defined by the highest surface of said apparatus.

18. The apparatus according to claim 17, wherein said two fixed gripping handles (57) are parallel to said first (2) and second (3) bearing axles and disposed above these axles.

19. The apparatus according to claim 1, further comprising:

a rotary electric connector (62) for a connection to an electric supply cable (61), which permits said electric supply cable to be connected to said apparatus according to a connection with a degree of rotational freedom.

20. The apparatus according to claim 1, wherein said rotary means, for displacing the apparatus and defining one (2) at least of said first and second bearing axles, include a first (5) and a second (6) rotating roller, the respective axes of rotation (7, 8) of which are aligned on said one (2) at least of said first and second bearing axles, and wherein said first (5) and second (6) rotating rollers are connected by a connection (9) of the freewheel type.

* * * * *